United States Patent [19]

Rupert et al.

[11] 4,413,434

[45] Nov. 8, 1983

[54] SUBSURFACE SIGN ASSEMBLY

[76] Inventors: John G. Rupert, 795 Frederica St., Apt. No. 1, Atlanta, Ga. 30306; Kenneth N. Jensen, 444 Sterling St., NE., Atlanta, Ga. 30307

[21] Appl. No.: 382,963

[22] Filed: May 28, 1982

[51] Int. Cl.[3] ..... G09F 3/18

[52] U.S. Cl. ..... 40/10 R; 40/16; 40/159

[58] Field of Search ..... 40/10 R, 159, 10, 124.1, 40/16

[56] References Cited

U.S. PATENT DOCUMENTS

| | | | |
|---|---|---|---|
| 1,430,980 | 10/1922 | Gideon . | |
| 1,787,335 | 12/1930 | Anderson . | |
| 1,956,527 | 4/1934 | De Groot | 40/159 |
| 2,052,771 | 9/1936 | Johnson | 40/128 |
| 2,162,025 | 6/1939 | McClaughry | 40/152.1 |
| 2,984,922 | 5/1961 | Ladenburger et al. | 40/159 |
| 3,071,881 | 1/1963 | Rutterbusch | 40/159 |
| 3,102,351 | 9/1963 | Howell | 40/125 |
| 3,425,147 | 2/1969 | Marx | 40/10 R |
| 3,803,738 | 4/1974 | Weiss | 40/64 R |
| 3,826,026 | 7/1974 | Bevan | 40/16 |
| 3,837,987 | 9/1974 | Williams | 40/159 |
| 3,918,187 | 11/1975 | Vogele | 40/156 |
| 4,217,713 | 8/1980 | Greenberger | 40/18 |

*Primary Examiner*—Gene Mancene

*Assistant Examiner*—Wenceslao J. Contreras

*Attorney, Agent, or Firm*—Thomas & Kennedy

[57] ABSTRACT

A transparent face plate is mounted to a back plate in parallel spaced relationship by double face adhesive strip material extending about the facing edge portions of the back plate and face plate, leaving a pocket between the back plate and face plate. The adhesive strip material does not extend across one common edge portion of the back plate and face plate so that a slot is formed between the plates and a sign plate can be slid through the slot, into and out of the pocket. A layer of opaque material is applied to the inside surface at the edge portions of the face plate to form an opaque border about the sign assembly which hides the double face adhesive strip from view through the face plate, and the opaque material extends beyond the adhesive strip material inwardly with respect to the pocket of the sign assembly so as to hide the perimeter of the sign plate from view through the face plate. Openings are formed in the opposite edge portions of the sign plate, and a sign plate removal tool is provided that comprises a substantially flat strip of material with cleats protruding from opposite sides thereof, whereby the tool can be inserted through the slot between the back plate and face plate, adjacent the sign plate, so that a cleat of the tool engages the opening in the sign plate and the tool can withdraw the sign plate from the pocket.

10 Claims, 4 Drawing Figures

SUBSURFACE SIGN ASSEMBLY

BACKGROUND OF THE INVENTIONN

The invention disclosed herein generally relates to a subsurface sign assembly of the type in which the exterior face plate of the sign is transparent and the graphics are located behind the face plate and visible through the face plate; and more specifically to a subsurface sign assembly that includes a sign plate that can be inserted behind and removed from behind a transparent face plate.

Subsurface sign assemblies typically are used in situations where the sign is subject to deterioration due to weather conditions, vandalism and other conditions. When the graphics of a sign are exposed on the visible surface of the sign, the graphics can be picked or scraped from the surface by valdalism, and the graphics are exposed to weather conditions, etc. which tend to deteriorate the color and other features of the graphics.

While subsurface sign assemblies tend to solve the problems of vandalism and atmospheric deterioration of sign graphics, the typical subsurface sign is a "permanent" assembly, in that the graphics are applied internally to the transparent face plate and the transparent face plate is permanently mounted to an opaque back plate. If the owner of the sign wishes to change the graphics of the sign, the sign must be removed and replaced with another sign bearing the desired graphics.

While various subsurface sign assemblies have been developed in which a sign plate that bears the sign graphics is positioned behind a transparent face plate, and which include the ability to remove the sign plate and to replace the sign plate with another sign plate bearing different graphics, the various structural arrangements of the prior art changeable subsurface sign assemblies have been visually displeasing and the structure which provides the changeable feature of such signs is visible to the observer, so that the observer can change the sign without authorization from the owner of the sign.

SUMMARY OF THE INVENTION

Briefly described, the present invention comprises a subsurface sign assembly which includes a back plate for mounting to a wall surface, etc., a transparent face plate which is congruent with respect to the back plate and which is mounted to the back plate in parallel spaced relationship by double surface adhesive strip material or similar spacer means which extend about most of the perimeter of the back plate and face plate, but which leaves a slot opening for the insertion of a sign plate between the back plate and the transparent face plate. An opaque border is formed on the inner surface of the transparent face plate about the perimeter of the face plate, and the opaque border overlies and hides the adhesive strip material from view through the transparent face plate. The sign plate is inserted through the slot opening between the back plate and face plate into the pocket formed therebetween by the doubleface adhesive strip material. Openings are formed through opposed edge portions of the sign plate, with the openings being hidden behind the opaque border of the transparent face plate. A withdrawal tool is provided which includes cleats or protrusions for engaging the opening of the sign plate, by inserting the tool between the back plate and face plate, adjacent the sign plate, so that a cleat of the tool is inserted into the opening of the sign plate, whereupon the tool can be pulled from the sign assembly and withdraws the sign plate from the pocket between the back plate and face plate. The sign graphics are applied to the surface of the sign plate that faces the transparent face plate.

Since the opaque border of the transparent face plate hides the peripheral edge portion of the sign plate, there is no visible indication about the transparent face plate that the sign plate can be withdrawn from the sign assembly, so that vandalism of the sign assembly is unlikely.

Thus, it is an object of this invention to provide a changeable subsurface sign assembly having the appearance of a single unit subsurface printed sign in which the sign graphics can be changed without removing the rest of the sign assembly from the support wall.

Another object of this invention is to provide a subsurface sign assembly with a removable sign plate that can be inserted into and withdrawn from a pocket formed by a transparent face plate mounted to a back plate, and which includes a withdrawal tool for insertion between the face plate and back plate adjacent the sign plate, for engaging and withdrawing the sign plate from the rest of the sign assembly.

Another object of this invention is to provide an inexpensive subsurface sign assembly which is neat in appearance, and which enables the graphics of the sign assembly to be changed substantially without visually indicating how the graphics can be changed.

Other objects, features and advantages of this invention will become apparent upon reading the following specification, when taken in conjunction with the accompanying drawings.

DETAILED DESCRIPTION

Figure 1:
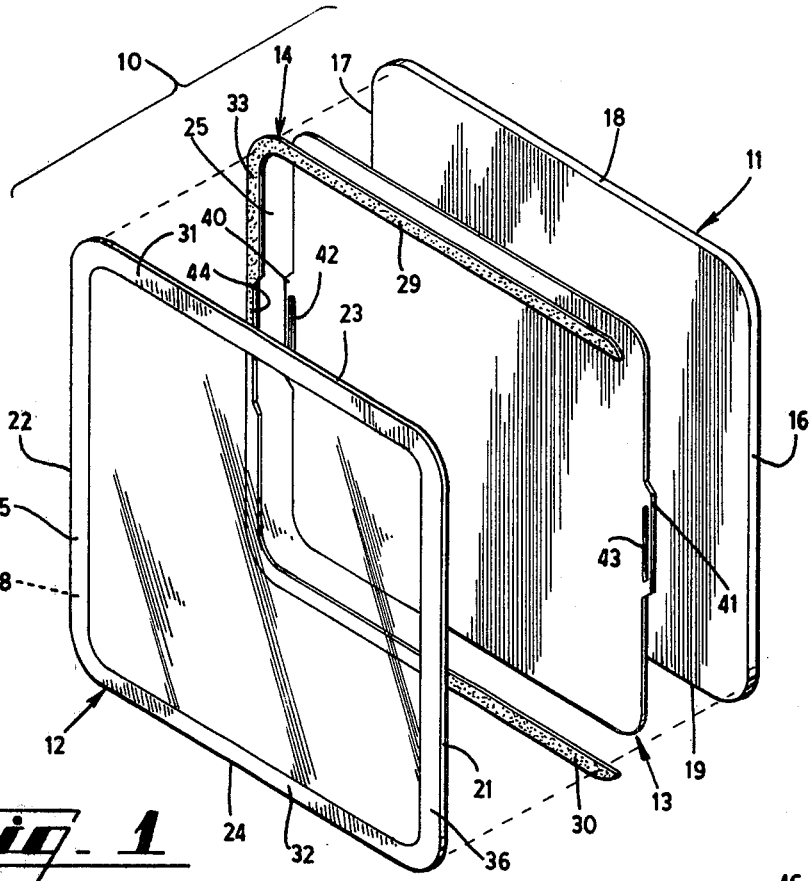
FIG. 1 is an exploded perspective illustration of the subsurface sign assembly.

Referring now in more detail to the drawings, in which like numerals indicate like parts throughout the several views, FIG. 1 illustrates the subsurface sign assembly 10 which includes a back plate 11, a transparent face plate 12, a sign plate 13 and doubleface adhesive strip material 14. In the embodiment illustrated, back plate 11 and face plate 12 are approximately rectangular with rounded corners. Back plate 11 includes opposed side edges 16 and 17, top edge 18 and bottom edge 19. Face plate 12 includes similar side edges 21 and 22, top edge 23 and bottom edge 24. Back plate 11 and face plate 12 are congruent and are arranged in parallel overlying relationship so that their edges are coextensive.

Doubleface adhesive strip material 14 comprises strip material with adhesive applied to its opposite surfaces. The strip material is applied between the back plate 11 and face plate 12 at three of their four peripheral edge portions, in an approximate U-shape, leaving a pocket 25 between the back plate 11 and face plate 12. The uniform thickness of the doubleface adhesive strip material 14 maintains the back plate and face plate 12 in parallel relationship with respect to each other and maintains a space of uniform thickness between the back plate and face plate. Thus, the back plate 11, face plate 12 and strip material 14 form a frame assembly, with a slot opening 26 at the common edges 16 and 21 of the back plate and face plate.

A layer of opaque material, such as paint 28 is applied to the inside surface of face plate 12 about the edged portion at the perimeter of the face plate, so that the opaque material extends from the outer edge of the face plate 12 inwardly of the face plate. The width of the opaque material 28 is greater than the width of the adhesive strip material 14, so that the opaque material 28 extends inwardly beyond the inner edge of the adhesive strip material 14. Thus, the opaque material 28 forms a border about the frame assembly which hides the adhesive strip material 14 from view through the transparent face plate 12.

The border formed by the opaque material 28 also extends along the fourth edge portion 21 of the transparent face plate so that there is no indication from the front of the sign assembly that there is a slot opening formed by the adhesive strip material applied to three of the four edges of the sign assembly.

Sign plate 13 is of a thickness slightly less than the adhesive strip material, and therefore slightly less than the distance between base plate 11 and face plate 12, and of a height slightly less than the distance between the inner edges of the top and bottom spans 29 and 30 of the adhesive strip material but of a height slightly greater than the distance between the inner edges of the top and bottom spans 31 and 32 of the opaque border 28 of the face plate 12. Likewise, the sign plate 13 is of a width slightly less than the distance between the inside edge of the vertical span 33 of the adhesive strip material 14 to the opposite side edge 21 of the face plate 12, but slightly greater in width than the distance between the inner edge of the vertical span 35 of the border 28 and the inside edge of the other vertical span 36 of the border 28. With this arrangement, the top and bottom spans 31 and 32 and vertical spans 35 and 36 of border 28 will overlie and therefore hide the vertical and horizontal edges of sign plate 13 from view through transparent face plate 12.

In the embodiment illustrated herein, sign plate 13 includes side protrusions 40 and 41 which project beyond the opposite side edges of the sign plate, and openings 42 and 43 are formed in sign plate 13 at the protruding portions 40 and 41. The adhesive strip material 14 defines a recess 44 for receiving a protrusion 40 or 41. The openings 42 and 43 are spaced apart a distance so that the openings will be located behind the vertical spans 35 and 36 of the opaque border applied to transparent face plate 12 when sign plate 13 is in position within its pocket 25 of the frame assembly. Therefore, the edges of the sign plate as well as its protrusions and openings are hidden from view when the sign plate is properly located in its pocket 25 between the base plate and face plate of the frame assembly.

The adhesive strip material 14 does not have adhesive applied to its inner and outer edges, only to its broad surfaces that are applied to the back plate 11 and to face plate 12. Therefore, the outer perimeter of the frame assembly is smooth in appearance and to the touch. Likewise, the inner surfaces of the adhesive strip material which are contacted by the edges of the sign plate 13 are relatively smooth, so that sign plate 13 can be readily slid into and out of the pocket 25 formed by the base plate 11, adhesive strip material 14, and face plate 12.

Figure 3:
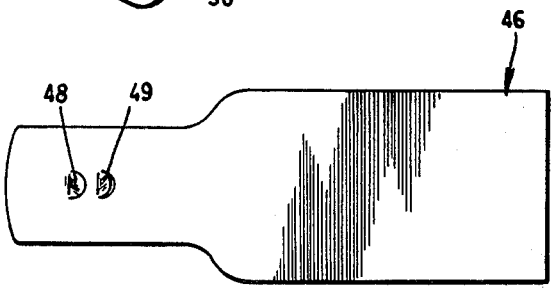
FIG. 3 is a side elevational view of the withdrawal tool.
Figure 4:
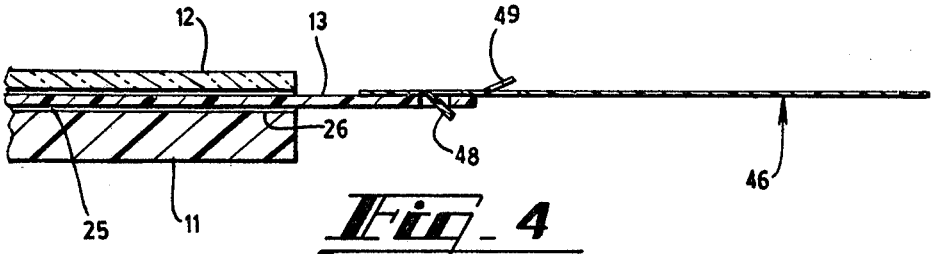
FIG. 4 is an edge view of the withdrawal tool, illustrating how the tool is used to withdraw the sign plate from between the back plate and transparent face plate.
Figure 2:
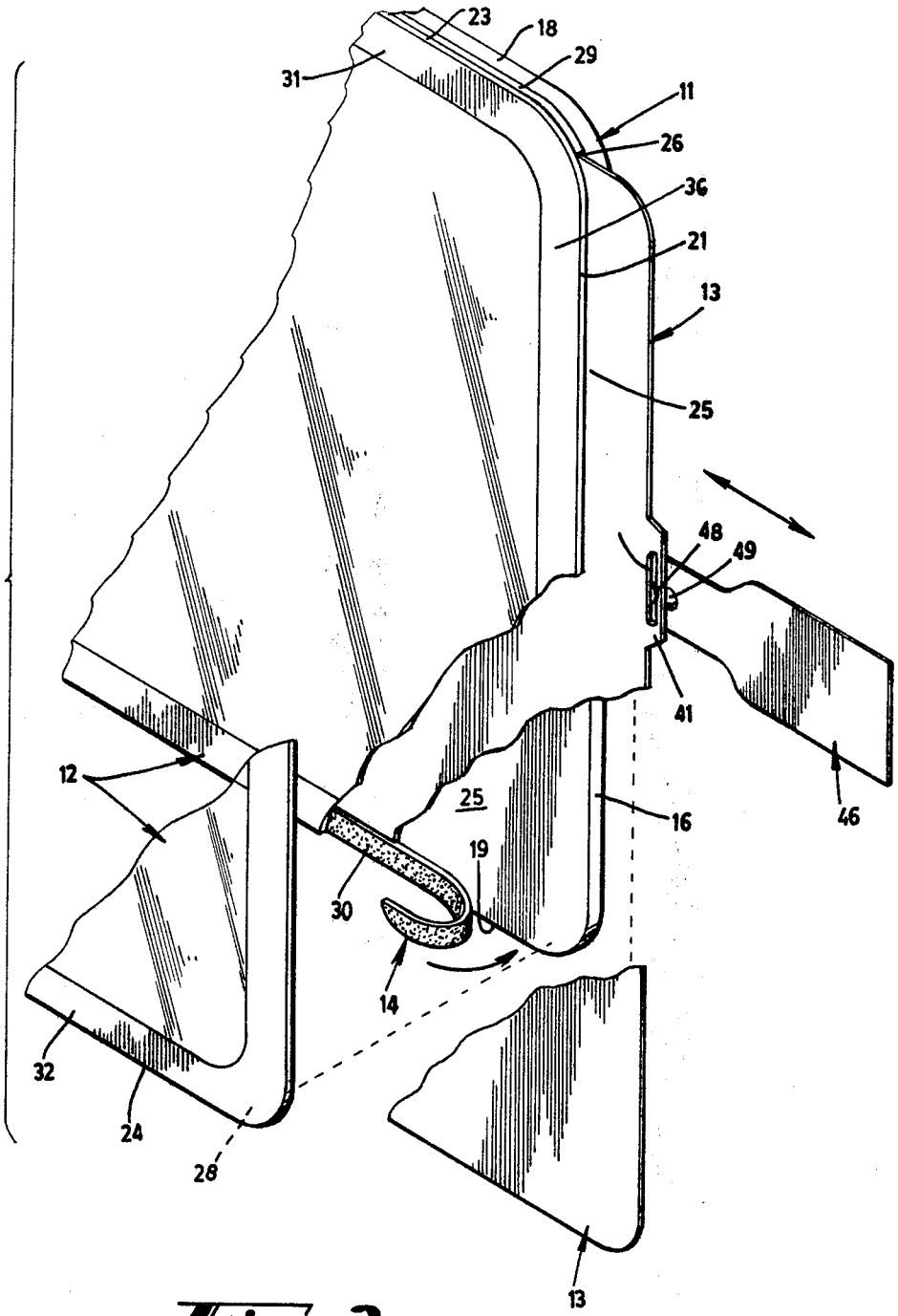
FIG. 2 is a perspective exploded illustration of a corner of the subsurface sign assembly.

As illustrated in FIGS. 3 and 4, a sign plate withdrawal tool 46 is provided for the purpose of withdrawing the sign plate 13 from the pocket 25 of the frame assembly. Withdrawal tool 46 is fabricated from flat sheet material and includes cleats or tabs 48 and 49 protruding from one end portion thereof. The cleats 48 and 49 are cut from the sheet material of the withdrawal tool 46 and are bent or angled outwardly from the plane of the sheet material, as best illustrated in FIG. 4. The cleats 48 and 49 are bent in opposite lateral directions from the plane of the sheet material. The end portion of the withdrawal tool that bears the cleats 48 and 49 is of a thickness small enough that permits it to be inserted in between base plate 11 and face plate 12, adjacent sign plate 13. The cleats 48 and 49 are bent in a longitudinal direction away from the direction of insertion of the tool into the frame assembly, so that the cleats will not inhibit the insertion movement of the tool. The cleats 48 and 49 tend to be compressed back toward the plane of the insertion tool as the tool is inserted into the frame assembly, but when one of the cleats 48 or 49 registers with an opening 42 or 43 at the open edge portion of the frame assembly, that cleat will be biased inwardly with respect to the opening. When the withdrawal tool is then pulled from the frame assembly, the cleat 48 or 49 which is in registration with the opening 42 or 43 will tend to pull the sign plate 13 from the pocket 25 formed between the base plate 11 and the face plate 12. In this manner, the sign plate 13 can be inserted manually and removed with withdrawal tool 46, as may be desired, to change the sign plate 13, and therefore change the graphics displayed by the sign assembly 10.

In order to provide a pleasing visual appearance, sign plate 13 is formed with a uniform color, as by applying paint to the surface of the sign plate that is to be visually exposed in the frame assembly, and lettering is then applied to the surface of the sign plate which is to be exposed. The lettering can be painted as by a stencil and a spray paint applied to the sign plate, or by other means, such as by the use of a release sheet with lettering applied thereto, with the lettering being removable from the release sheet by friction or by heat. Other means can be provided for the application of lettering or other graphics to the sign plate 13. In some instances, the sign plate 13 will have one message applied to one of its surfaces and another message applied to its opposite surface, so that the sign plate can be turned over to provide the alternate messages.

Although the adhesive strip material 14 has been disclosed as the spacer means for maintaining the back plate 11 and face plate 12 in parallel spaced relationship, the back plate can be formed with a raised rim that projects from its periphery toward the face plate, and the rim can be adhesively or mechanically fastened to the face plate. With this structural arrangement the rim of the back plate would function as the spacer means.

While this invention has been described in detail with particular reference to a preferred embodiment thereof, it will be understood that variations and modifications can be effected within the spirit and scope of the invention as described hereinbefore and as defined in the appended claims.

We claim:

1. A subsurface sign assembly comprising a back plate for mounting to a wall surface or the like, a transparent face plate, double face adhesive strip material contacting one surface of said back plate and the facing surface of said transparent face plate for mounting said face plate to said back plate and maintaining said face plate in spaced relationship with said back plate, said adhesive strip material being arranged between said back plate and said face plate to form a sign plate space between said back plate and said face plate, with said sign plate space open along at least one edge portion of said sign assembly, a sign plate bearing indicia on at least one surface thereof and positioned in said sign plate space with the surface bearing the indicia facing said transparent face plate, whereby said sign plate can be inserted between and withdrawn from between the back plate and the face plate through the open edge portion of the sign assembly, the surface of said face plate which faces said back plate including a layer of opaque material applied thereto at its perimeter which extends inwardly from the edges of said face plate and which overlies said adhesive strip and hides said adhesive strip from view through said face plate, and wherein the edge portions of said sign plate are juxtaposed the opaque material and the opaque material hides the edge portions of said sign plate from view through said face plate.

2. The subsurface sign assembly of claim 1 and wherein said back plate and said face plate are congruent and wherein said adhesive strip extends from the edges of said back plate and said face plate inwardly between said back plate and said face plate, and wherein the inner and outer edge portions of said adhesive strip material are adhesive-free, whereby the sign plate can slide in contact with the inner edge portions of said adhesive strip material.

3. The subsurface sign assembly of claim 1 and wherein said sign plate defines an opening adjacent one edge portion thereof, and wherein said opening is juxtaposed the overlying portion of the opaque material and the opaque material hides the opening of said sign plate from view through said face plate.

4. The subsurface sign assembly of claim 1 and further including a sign plate removal tool comprising a substantially flat strip of material of a thickness small enough to be inserted between said back plate and said face plate adjacent said sign plate, said removal tool including at least one protruding cleat for insertion into the opening of said sign plate, whereby when a cleat of the tool is inserted into the opening of the sign plate the sign plate can be withdrawn from between the back plate and the face plate by pulling the tool.

5. The subsurface sign assembly of claim 4 and wherein said cleat is formed by a portion of the material of said removal tool being partially struck from the removal tool and bent away from the plane of the removal tool.

6. The subsurface sign assembly of claim 4 and wherein said at least one cleat comprises cleats formed by a portion of the material of said removal tool being partially struck from the removal tool and bent away from the plane of the removal tool, with at least one cleat bent in one direction away from the plane of the removal tool and at least another cleat bent in the opposite direction away from the plane of the removal tool.

7. The subsurface sign assembly of claim 1 and wherein said back plate and said face plate are congruent and rectangular, and wherein said adhesive strip material extends continuously about three edges of said sign assembly, forming said sign plate space.

8. A subsurface sign assembly comprising a polygonal back plate for mounting to a wall surface or the like, a polygonal transparent face plate, said back plate and said face plate being congruent and arranged in overlying relationship, spacer means maintaining said back plate and said face plate in parallel spaced relationship, said spacer means positioned about and extending inwardly from the peripheral edge portions of said back plate and said spacer plate and forming a sign plate pocket between said back plate and said face plate with one peripheral edge portion remaining open whereby a sign plate opening is formed through which a sign plate is to be inserted, a layer of opaque material applied to the surface of said face plate which faces said back plate about the peripheral portion of said face plate and extending from all of the peripheral edges of said face plate inwardly a distance greater than the distance which said spacer means is positioned inwardly from the peripheral portion of said face plate whereby said layer of opaque material forms an opaque border about said sign assembly which hides the spacer means from view through said face plate, and a sign plate of a shape corresponding to said opaque border and of an area larger than the area defined by the inner edge portion of said opaque border whereby the opaque border hides the peripheral edge portions of said sign plate from view through said face plate.

9. The subsurface sign assembly of claim 8 and wherein said sign plate includes an opening therethrough adjacent one edge portion thereof, and said opaque border being shaped to hide the opening from view through said face plate.

10. The subsurface sign assembly of claim 8 and wherein said sign plate includes a protrusion on opposite edge portions thereof, and wherein each protrusion defines an opening therethrough, said pocket formed between said back plate and face plate shaped to receive said protrusions, and said border being shaped to hide the protrusions and the openings through said protrusions from view through said face plate.

* * * * *